US005433316A

United States Patent [19]

McQueeny

[11] Patent Number: 5,433,316

[45] Date of Patent: Jul. 18, 1995

[54] MULTI-COMPARTMENT PACKAGE

[75] Inventor: Thomas P. McQueeny, Chicago, Ill.

[73] Assignee: R. R. Donnelley & Sons Company, Lisle, Ill.

[21] Appl. No.: 136,384

[22] Filed: Oct. 13, 1993

[51] Int. Cl.[6] ..... B65D 21/02; B65D 85/57

[52] U.S. Cl. ..... 206/232; 206/308.3; 220/23.83; 229/120.01

[58] Field of Search ..... 206/232, 315.1, 444, 206/579, 309, 308.3; 220/23.4, 23.83, 23.86; 229/120.01

[56] References Cited

U.S. PATENT DOCUMENTS

| | | | |
|---|---|---|---|
| 4,179,062 | 12/1979 | Baker | 229/120.01 |
| 4,523,680 | 6/1985 | Saito | 220/23.4 |
| 4,592,478 | 6/1986 | Laconis | 220/23.83 |
| 5,022,547 | 6/1991 | Spangler | 220/23.4 |
| 5,176,281 | 1/1993 | Fiore | 220/23.86 |

FOREIGN PATENT DOCUMENTS

| | | | |
|---|---|---|---|
| 0236854 | 3/1964 | Austria | 220/23.4 |
| 0200587 | 9/1991 | Japan | 220/23.4 |

*Primary Examiner*—Jimmy G. Foster

*Attorney, Agent, or Firm*—Marshall, O'Toole, Gerstein, Murray & Borun

[57] ABSTRACT

In order to sell a multimedia product such as documentation and/or software and/or related toys or the like in an effective yet intriguing manner, a multi-compartment package is provided which includes first and second containers. The first container defines an enclosure for a first product such as documentation and/or toys, and it has a surface with an outwardly-facing channel formed therein. The second container defines an enclosure for a second product such as software in the form of diskettes, and it is formed to slide in the outwardly-facing channel in the first container. In addition, the multi-compartment package is formed in such a manner that the second container is retained within the outwardly-facing channel of the first container in a manner accommodating relative sliding movement therewithin.

19 Claims, 1 Drawing Sheet

MULTI-COMPARTMENT PACKAGE

FIELD OF THE INVENTION

The present invention is generally directed to the field of packaging for products and, still more particularly, a multi-compartment package for multimedia such as documentation and/or a toy and/or software.

BACKGROUND OF THE INVENTION

Over the years, the field of packaging for products has evolved with the products that are to be sold therewithin. It is generally known that packaging of all types has become much more sophisticated in recent years to not only provide effective packaging for shipping purposes but also packaging which actually serves to assist in the successful marketing of the product itself. In fact, the field of packaging has reached a level of sophistication that is regarded as having great marketing significance.

More specifically, the packaging for a product is known to be a key factor in the overall product marketing effort. The fact is that consumers are inundated with such a proliferation of different products and packages that there is great competition among companies to attract initial attention of consumers by reason of their packaging, particularly in the normal setting of a retail store. In many cases, this can spell the difference between success and failure regardless of the quality of a product.

Still additionally, it is nonetheless the case that the conventional requirements for packaging must be successfully achieved. This means that the packaging must be protective of the contents both during shipping and on the store shelf. With regard to software, it is particularly important for the diskettes and/or documentation, and/or toys to be adequately protected.

The present invention is directed to overcoming one or more of the foregoing problems and achieving one or more of the resulting objects.

SUMMARY OF THE INVENTION

It is therefore a principal object of the present invention to provide a unique multi-compartment package. It is another object of the present invention to provide such a package for multimedia products and the like such as software and/or documentation and/or accompanying toys. It is a further object of the present invention to provide a sliding container-within-a container package.

Accordingly, the present invention is directed to a multi-compartment package comprising first and second containers. The first container defines an enclosure for a first product and includes an outwardly-facing front surface. The second container defines an enclosure for a second product and is formed to slide relative to the outwardly-facing front surface of the first container. Additionally, means are provided for guiding the second container in sliding movement relative to the outwardly-facing front surface of the first container.

Advantageously, in the preferred embodiment the first container has a surface with an outwardly-facing channel formed therein. The second container is then preferably formed to slide in the outwardly-facing channel in the first container. Further, means are provided for retaining the second container within the outwardly-facing channel of the first container.

In the exemplary embodiment, the first container is generally rectangular and includes a front surface, a rear surface, a top surface, a bottom surface, and a pair of side surfaces. It is also advantageous for the outwardly-facing channel in the first container to be formed so as to be generally rectangular in transverse cross-section. With this arrangement, the second container is also preferably generally rectangular and includes a front surface, a rear surface, a top surface, a bottom surface, and a pair of side surfaces.

In a highly preferred embodiment, the multi-compartment package is well suited for a multimedia product such as documentation and/or software and/or a toy or the like. Specifically, the enclosure of the first generally rectangular container is then adapted to receive documentation and/or a toy whereas the enclosure for the second generally rectangular container is adapted to receive software. Additionally, the retaining means is advantageously associated with corresponding opposite sides of the outwardly-facing channel and the second container to accommodate relative sliding movement therebetween.

More specifically, the associated retaining means preferably includes a pair of slots formed in the outwardly-facing channel and a pair of flanges formed on the second container. It is still additionally advantageous for the outwardly-facing channel in the surface of the first container to comprise a U-shaped recess of a depth equal to the depth of the second container. Preferably, the outwardly-facing channel is formed in the front surface of the first container to extend entirely between the bottom surface and the top surface of the first container.

In a most highly preferred embodiment, the top surface and the bottom surface of the first container are generally rectangular so as to form stops for the second container at opposite ends of the U-shaped recess defined by the outwardly-facing channel. It is also advantageous for at least the top surface of the first container and the top surface of the second container to include tuck-in flaps for gaining access to the documentation and/or toy and/or software, respectively. Still further, the package is preferably such that all of the surfaces of the first and second generally rectangular containers are flat surfaces which are disposed to extend generally perpendicular to each of the adjacent ones of the surfaces.

Other objects, advantages and features of the present invention will become apparent from a consideration of the following specification taken in conjunction with the accompanying drawings.

DETAILED DESCRIPTION OF THE PREFERRED EMBODIMENT

Figure 1:
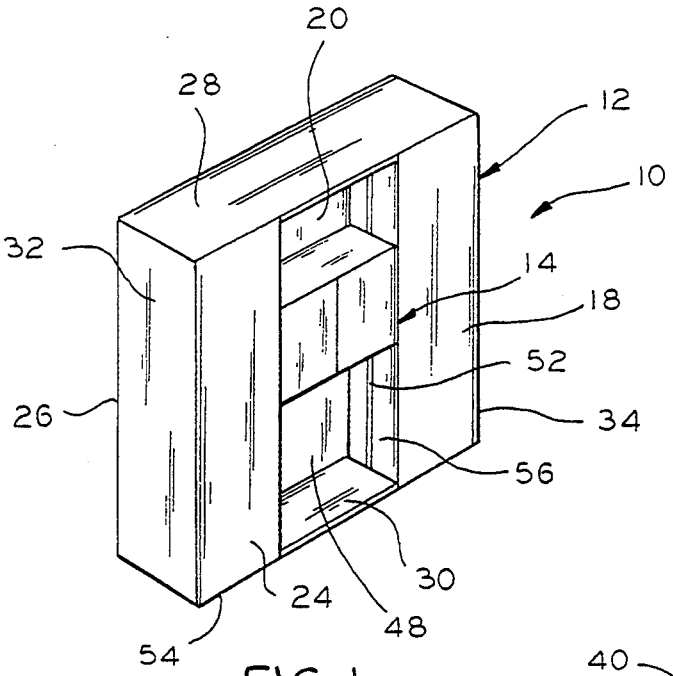
FIG. 1 is a perspective view of a multi-compartment package in accordance with the present invention.

In the illustrations given, and with reference first to FIG. 1, the reference numeral 10 designates generally a multi-compartment package which is suitably comprised of first and second containers 12 and 14, respectively. The first container 12 defines an enclosure 16 for a first product (not shown), and it has a surface 18 with an outwardly-facing channel 20 therein (see FIG. 2). The second container 14 defines an enclosure 22 for a second product (not shown), and it is formed to slide in the outwardly-facing channel 20 in the first container 12 (see FIG. 3). With specific reference to FIG. 2, the multi-compartment package 10 will also be understood to include means for guiding or retaining the second container 14 within the outwardly-facing channel 20 of the first container 12, as will be described in greater detail hereinafter.

Figure 3:
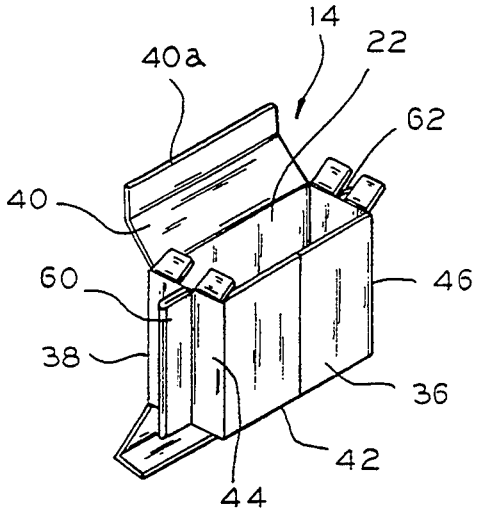
FIG. 3 is a perspective view of the small container shown in FIG. 1 but with a flap illustrated in an open position.
Figure 2:
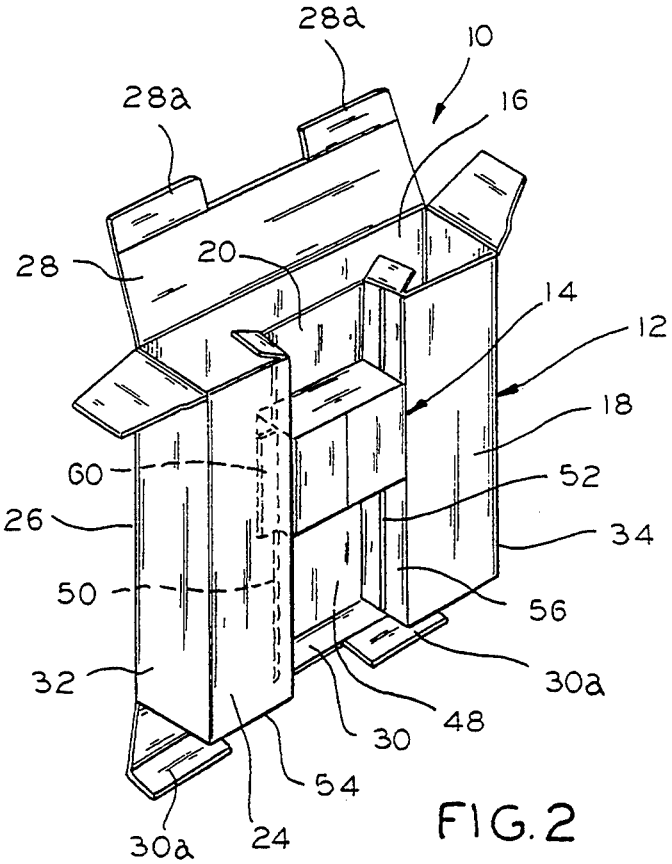
FIG. 2 is a perspective view similar to FIG. 1 but with flaps of the larger container illustrated in an open position.

Still referring to FIG. 2, it will be understood that the multi-compartment package 10 is particularly well suited for multimedia products such as software and/or documentation and/or related toys or the like. The enclosure 16 of the first container 12 will be seen to be particularly well suited for documentation and/or toys (see FIG. 2) whereas the enclosure 22 of the second container 14 is advantageously formed in such manner as to receive software such as 3½ inch diskettes and the like (see FIG. 3). As shown in FIGS. 1 through 3, the first and second containers 12 and 14 are both generally rectangular and the outwardly-facing channel 20 in the first container 12 is generally rectangular in transverse cross-section.

As will be appreciated from FIG. 2, the first container 12 includes an outwardly-facing front surface 24, a rear surface 26, a top surface 28, a bottom surface 30, and a pair of side surfaces 32 and 34. Referring to FIG. 3, the second container 14 also includes an outwardly-facing front surface 36, a rear surface 38, a top surface 40, a bottom surface 42, and a pair of side surfaces 44 and 46.

Referring specifically to FIG. 2, the outwardly-facing channel 20 in the first container 12 comprises a U-shaped recess 48 in the flat front surface 18 of a depth substantially the same as the depth of the second container 14. It will, therefore, be seen and appreciated that the outwardly-facing channel 20 is generally rectangular in transverse cross-section. Also as shown, the retaining means includes a pair of slots 50 and 52 on opposite sides 54 and 56 of the outwardly-facing channel 20 and a pair of flanges 60 and 62 on opposite sides 44 and 46 of the second container 14.

Referring now to FIGS. 1 and 2, the outwardly-facing channel 20 is formed in the flat front surface 18 of the first container 12 to extend entirely between the top surface 28 and the bottom surface 30 of the first container 12. It will also be seen that at least the top surface 28 and, preferably, the bottom surface 30 of the first container 12, as well as the top surface 40 of the second container 14, include tuck-in flaps **20*a*, 30*a*, and 40*a* for gaining access to the documentation and/or toys and the software, respectively, positioned in the first container 12 and the second container 14. As shown in FIG. 2, the top surface 28 and the bottom surface 30 of the first container 12 are generally rectangular so as to form stops for the second container 14 at opposite ends of the U-shaped recess 20** (see, also, FIG. 1).

As for other details of the multi-compartment package 10, all of the surfaces of the first and second generally rectangular containers 12 and 14 are flat surfaces extending generally perpendicular to each of the adjacent ones of the surfaces. Thus, the first container 12 in the illustrated embodiment is generally rectangular in shape with the exception of the flat front surface 18 having the U-shaped recess 20 therein and the second container 14 is generally rectangular and, advantageously, square to receive 3½ inch diskettes. With regard to the second container 14, the pair of flanges 60 and 62 formed on the side surfaces 44 and 46 are formed in such a manner as to be generally coextensive with, i.e., the same length as, the side surfaces 44 and 46 as shown in FIG. 3.

By appropriately sizing the various portions of the package 10, the second container 14 is adapted to slide in the U-shaped recess 20 relative to the first container 12. Thus, the relative sizing of the slots 50 and 52 and corresponding flanges 60 and 62 as well as the relative sizing of the second container 14 relative to the U-shaped recess 20 is such that there is relatively free movement of the second container 14 relative to the first container 12 by reason of gravitational forces depending upon the orientation of the first container 12. In other words, the second container 14 may appropriately be referred to as an "elevator box" which allows the consumer to make the second container 14 to undergo guided sliding movement relative to the outwardly-facing front surface 24 of the first container 12.

For security purposes, the multi-compartment package 10 may be covered, for instance, by a transparent shrink-wrap. Thus, appropriate graphics may be applied to the first container 12 and the second container 14 to provide the relevant trademark or trademarks as well as product identification and/or use information and the like. Also, in this manner, the software and/or documentation and/or related toys are not readily available to access by the consumer.

While in the foregoing there has been set forth a preferred embodiment of the invention, it will be appreciated that the details herein given may be varied by those skilled in the art without departing from the true spirit and scope of the appended claims.

What is claimed is:

1. A multi-compartment package, comprising:

a first container defining an enclosure for a first product and having a front surface with an outwardly-facing channel formed therein, said outwardly-facing channel being formed in said front surface of said first container to extend entirely from a bottom surface to a top surface thereof;

a second container defining an enclosure for a second product and being sized relative to said channel to slide in said outwardly-facing channel in said first container back and forth toward and away from said top and bottom surfaces; and means for retaining said second container within said outwardly-facing channel of said first container for confined back and forth sliding movement relative to said first container toward and away from said top and bottom surface of said first container.

2. The multi-compartment package of claim 1 wherein said first container is generally rectangular and further includes a rear surface and a pair of side surfaces.

3. The multi-compartment package of claim 1 wherein said second container is generally rectangular and includes a front surface, a rear surface, a top surface, a bottom surface, and a pair of side surfaces.

4. The multi-compartment package of claim 1 wherein said second container and said outwardly-facing channel in said first container are both formed so as to be generally rectangular in transverse cross-section.

5. The multi-compartment package of claim 1 wherein said retaining means includes a pair of slots on opposite sides of said outwardly-facing channel and a pair of flanges on opposite sides of said second container.

6. The multi-compartment package of claim 1 wherein said outwardly-facing channel in said first container comprises a recess in said surface of a depth substantially the same as the depth of said second container.

7. A multi-compartment multimedia package, comprising:

a first generally rectangular container defining an enclosure for documentation and having a fiat front surface with an outwardly-facing channel formed therein, said outwardly-facing channel being formed in said flat front surface of said first container between a bottom surface and a top surface thereof;

a second generally rectangular container defining an enclosure for software formed to slide in said outwardly-facing channel in said first container; and means associated with corresponding opposite sides of said outwardly-facing channel and said second container for retaining said second container within said outwardly-facing channel of said first container for confined sliding movement relative to said first container toward and away from said top and bottom surfaces of said outwardly-facing channel.

8. The multi-compartment multimedia package of claim 7 wherein said generally rectangular first container further includes a rear surface and a pair of side surfaces.

9. The multi-compartment multimedia package of claim 7 wherein said generally rectangular second container includes a front surface, a rear surface, a top surface, a bottom surface, and a pair of side surfaces.

10. The multi-compartment multimedia package of claim 7 wherein said outwardly-facing channel in said surface of said first container is formed in such manner as to be generally rectangular in transverse cross-section.

11. The multi-compartment multimedia package of claim 7 wherein said associated retaining means includes a pair of slots formed in said outwardly-facing channel and a pair of flanges formed on said second container.

12. The multi-compartment multimedia package of claim 7 wherein said outwardly-facing channel in said surface of said first container comprises a recess in said surface of a depth equal to the depth of said second container.

13. A multi-compartment multimedia package, comprising:

a first generally rectangular container defining an enclosure for documentation and having a flat front surface with an outwardly-facing channel formed therein, said first container being formed so as to also include a rear surface, a top surface, a bottom surface, and a pair of side surfaces, said outwardly-facing channel being formed in said flat front surface of said first container to extend entirely between said bottom surface and said top surface thereof;

said outwardly-facing channel in said flat front surface of said first container being formed in such manner as to be generally rectangular in transverse cross-section:

a second generally rectangular container defining an enclosure for software formed to slide in said outwardly-facing channel in said first container, said second container being formed so as to include a front surface, a rear surface, a top surface, a bottom surface, and a pair of side surfaces; and means associated with corresponding opposite sides of said outwardly-facing channel and said second container for retaining said second container within said outwardly-facing channel of said first container for confined sliding movement relative to said first container toward and away from said top and bottom surfaces of said first container.

14. The multi-compartment multimedia package of claim 13 wherein said associated retaining means includes a pair of slots formed in said outwardly-facing channel and a pair of flanges formed on said side surfaces of said second container.

15. The multi-compartment multimedia package of claim 14 wherein said pair of flanges formed on said side surfaces of said second container are formed in such a manner as to be generally coextensive with said side surfaces of said second container.

16. The multi-compartment multimedia package of claim 13 wherein said outwardly-facing channel in said surface of said first container comprises a U-shaped recess in said surface of a depth substantially equal to the depth of said second container.

17. The multi-compartment multimedia package of claim 16 wherein said top surface and said bottom surface of said first container are generally rectangular so as to form stops for said second container at opposite ends of said U-shaped recess.

18. The multi-compartment multimedia package of claim 13 wherein at least said top surface of said first container and said top surface of said second container include rock-in flaps for gaining access to said documentation and software, respectively.

19. The multi-compartment multimedia package of claim 13 wherein all of said surfaces of said first and second generally rectangular containers are flat surfaces extending generally perpendicular to each of the adjacent ones of said surfaces.

* * * * *

UNITED STATES PATENT AND TRADEMARK OFFICE

CERTIFICATE OF CORRECTION

PATENT NO. : 5,433,316

DATED : July 18, 1995

INVENTOR : MCQUEENY, Thomas Patrick

It is certified that error appears in the above-identified patent and that said Letters Patent is hereby corrected as shown below:

Column 5, line 11, replace "fiat" with --flat--; and

Column 6, line 48, replace "rock" with --tuck--.

Signed and Sealed this

Nineteenth Day of December, 1995

*Attest:*

*Attesting Officer*

BRUCE LEHMAN

*Commissioner of Patents and Trademarks*